US005101913A

United States Patent [19]

Stockley, et al.

[11] Patent Number: 5,101,913

[45] Date of Patent: Apr. 7, 1992

[54] METHOD AND APPARATUS FOR DRILLING WELLS

[76] Inventor: Charles O. Stokley, 4535 Oakshire Dr., Houston, Tex. 77027; Richard C. Haas, 6669 Bent Trail, Corpus Christi, Tex. 78415

[21] Appl. No.: 593,056

[22] Filed: Oct. 5, 1990

[51] Int. Cl.[5] ..... E21B 3/02

[52] U.S. Cl. ..... 175/65; 175/195; 175/214; 175/215

[58] Field of Search ..... 175/65, 173, 195, 214, 175/215, 324

[56] References Cited

U.S. PATENT DOCUMENTS 3,823,788 7/1974 Garrison et al. ..... 175/215 X
4,480,703 11/1984 Garrett ..... 175/195
4,486,025 12/1984 Johnston ..... 175/195 X
4,949,796 8/1990 Williams ..... 175/214 X

*Primary Examiner*—William P. Neuder
*Attorney, Agent, or Firm*—M. H. Gay

[57] ABSTRACT

Method and apparatus for drilling wells in which the annulus between the casing and drill string is sealed below the kelly and blowout preventers and drilling fluid returns are conducted from below the seal to the exterior through the drilling head. The annulus may be controlled below the seal to permit lubricating the seal through the blowout preventers while maintaining the well under complete control. A surface controlled subsurface valve may control drilling fluid returns.

14 Claims, 9 Drawing Sheets

METHOD AND APPARATUS FOR DRILLING WELLS

This invention relates to methods and apparatus for drilling wells. In one aspect it relates particularly to methods and apparatus for sealing the casing-drill string annulus below the kelly or blowout preventers and recovering returning drilling fluids from the annulus below the seal.

Conventionally petroleum wells have been drilled with a stack of several blowout preventers mounted on a casing head and a rotary swivel or a rotary table above the blowout preventers. The blowout preventers control the casing-drill string annulus and may include a stack of several ram type preventers and an annular type preventer. Drilling fluid returns flow up the annulus between the casing and the drill string. Formation pressure is controlled by weighting the drilling fluid.

Materials used in the drilling fluid may damage the producing formation and it has been proposed to drill formations with fluids which does not include formation damaging materials. This proposal includes the use of a rotary table including a seal about the kelly available from Grant Oil Tools, Houston, Tex. as "Rotating Drilling Head Models 7068, 7368 and 8068. The Grant rotating head is mounted on top of the blowout preventer stack.

The Grant device may control very low pressure returns but it is not recommended for control of any substantial pressure and is subject to failure due to constant lateral movement of the kelly against the stripper rubber seal surrounding the kelly.

It is an object of this invention to provide a method and apparatus for drilling wells under conditions of substantial pressure in the casing-tubing annulus at the wellhead.

Another object is to provide a method and apparatus for drilling wells in which the casing-tubing annulus is sealed at the wellhead during drilling and wear problems on the seal element due to lateral movement of the kelly or drill pipe during drilling is substantially eliminated.

Another object is to provide a method and apparatus for drilling wells i which the casing-tubing annulus is sealed at the wellhead during drilling and sealing problems due to lateral movement of the kelly or drill pipe during drilling is substantially eliminated.

Another object is provide a method and apparatus for drilling wells in which the casing-tubing annulus is sealed at the wellhead during drilling by a seal means which may be removed and replaced while maintaining fluid under pressure in the annulus.

Another object is to provide a method and apparatus for drilling wells in which the casing-tubing annulus is sealed at the wellhead during drilling and a surface controlled subsurface valve controls flow of returning drilling fluid.

Another object is to provide a method and apparatus for drilling wells in which the casing-tubing annulus is sealed at the wellhead during drilling by a seal assembly secured in the wellhead by threads and a tool is provided for insertion in the drill string for removing and replacing the seal assembly without rotating the drill string below the tool.

Other objects, features and advantages of this invention will be apparent from the specification, drawings, and claims.

In the drawings wherein illustrative embodiments of the invention are shown and wherein like reference numerals indicate like parts:

In practicing this invention the surface casing 11 is installed in the well in the conventional manner. A drilling head 12 is installed on the outer or surface casing and an inner casing 13 extends downwardly from the drilling head. The drilling head has an outlet for returning drilling fluid as indicated at 14. The drilling head may be a conventional casing head such as those sold by Cameron Iron Works, Inc. Houston Tex.

Figure 1:
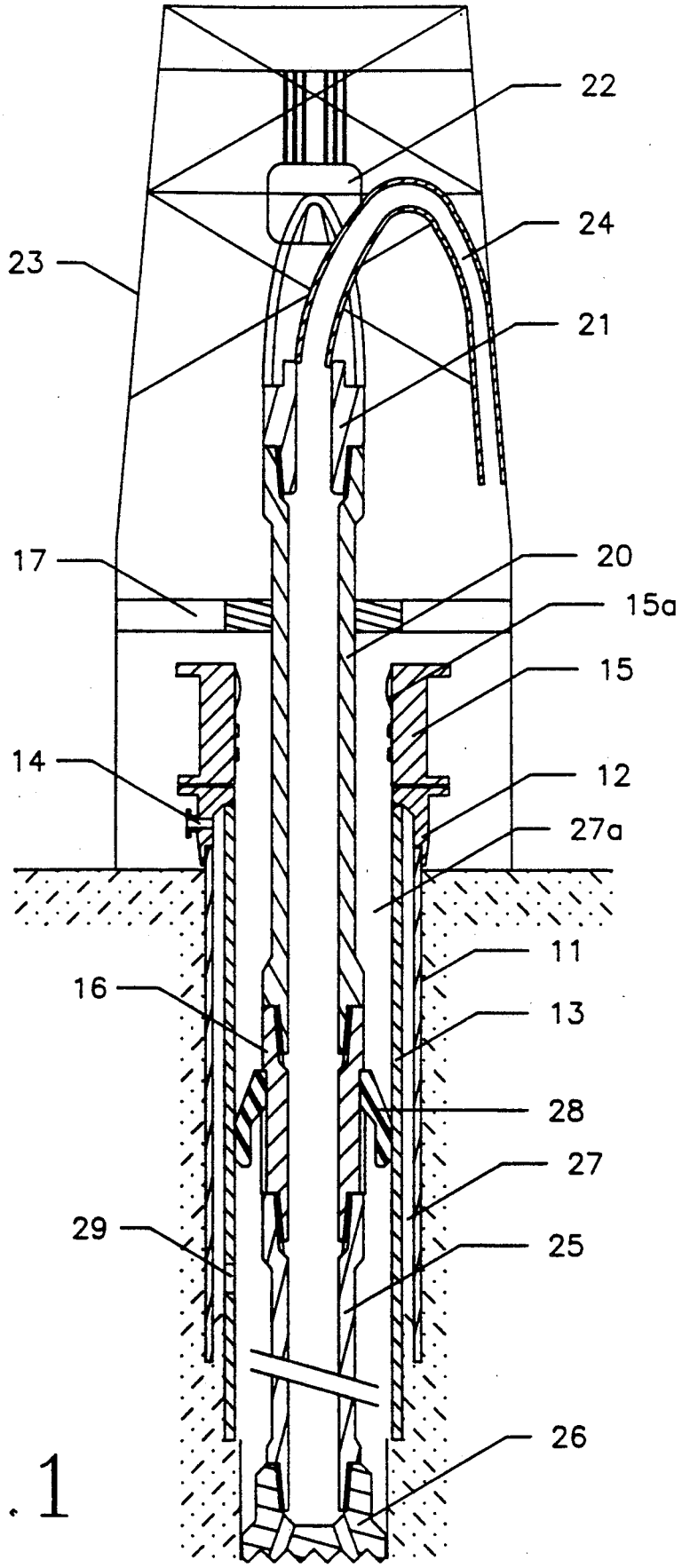
FIG. 1 is a sectional schematic view of a well being drilled while employing the methods and apparatus of this invention.

Blowout preventers 15 having seal means 15*a* (FIG. 1) for sealing with the drill string are mounted on the drilling head in the conventional manner. These blowout preventers will normally include several ram type preventers (including pipe engaging and blind types) stacked on top of the each other and may also be obtained from Cameron Iron Works, Inc. Conventionally the top most preventer will be an annular blowout preventer and may be obtained from Hydril Co., Houston, Tex. All of these conventional preventers are represented by the single schematic preventer 15 with drill string engaging means 15*a* in the drawings.

Figure 5:
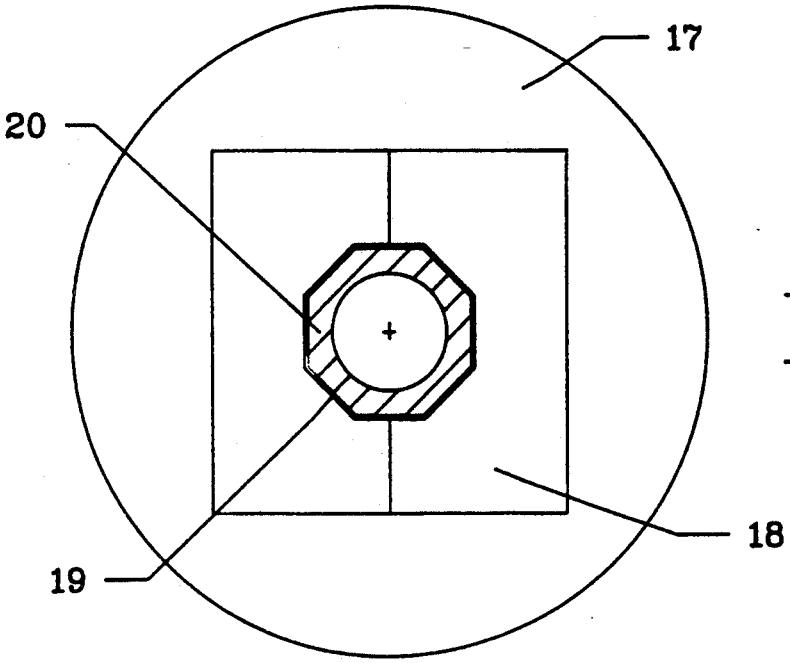
FIG. 5 is a top view of a conventional rotary table having a kelly bushing therein and a kelly shown in section which may be used with this invention.

To provide for rotation of the drill pipe 16 a conventional rotary table 17 supported on I-beams 17*a* is provide. This rotary table utilizes a conventional kelly bushing 18 (FIG. 5) having a bore with multiple flat sides 19 to impart rotation to the conventional kelly 20 at the top of the drill pipe through matching flat sides on the exterior of the kelly. In some instances a rotary swivel is substituted for the rotary table.

The kelly 20 is suspended on a swivel 21 hung from traveling block 22 which is supported in derrick 23. Drilling fluid is supplied to the drill pipe through mud hose 24.

At its lower end the drill pipe has a plurality of drilling collars 25 supporting a bit 26.

In accordance with this invention a sliding rotating seal 28 is provided between the inner casing and the drill pipe below the kelly. Thus the seal may have a round I. D. cooperable with the round 0. D. of the drill pipe. As the seal will be located a substantial distance below the rotary table 17 the problems of the kelly alignment with the inner casing at the rotary table, and misalignment of the rig 23 and/or the blowout preventers 15 is minimized due to the distance from the seal to the rotary table 17. As the seal will control the annulus 27*a* above the seal, said annulus may contain a lubricant.

Figure 2:
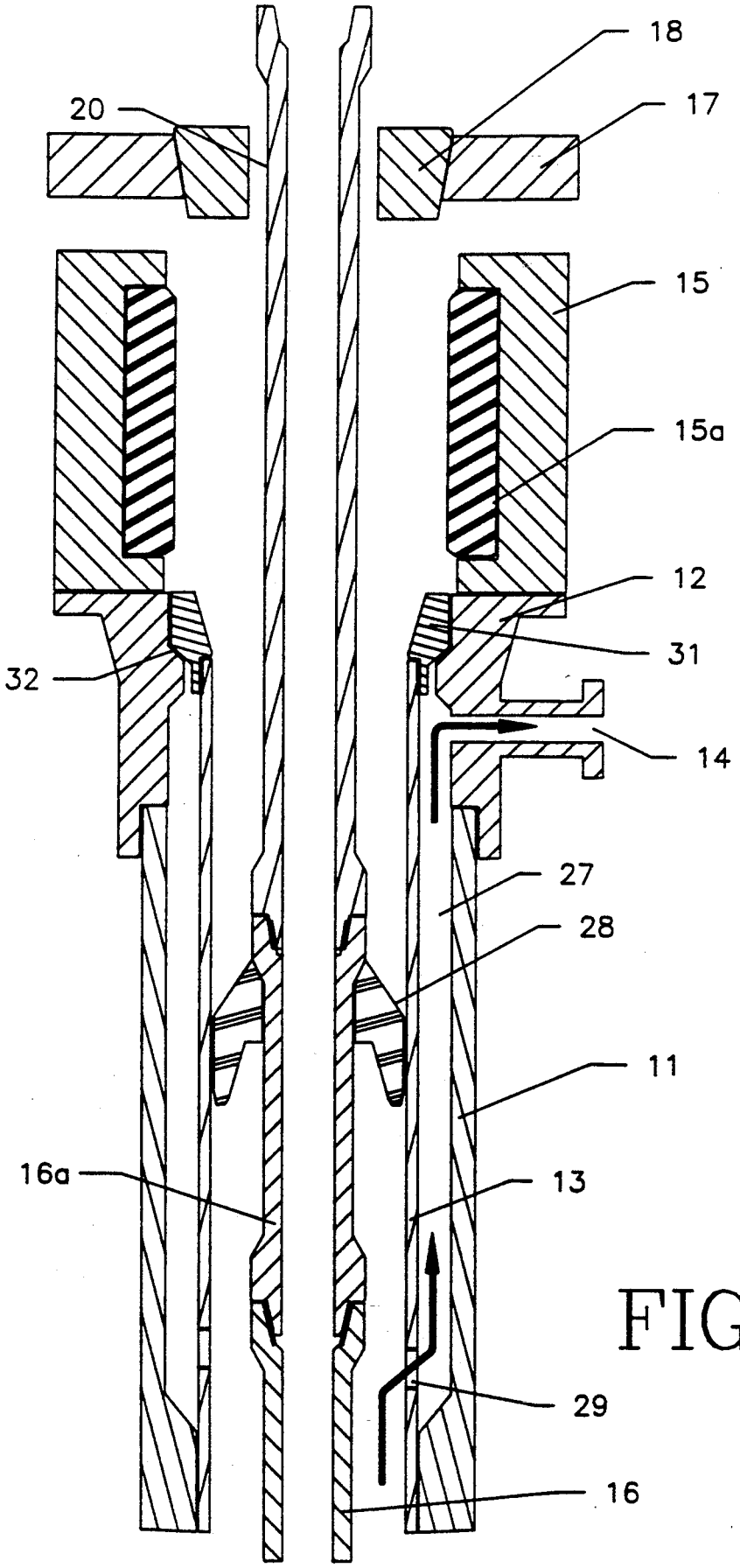
FIG. 2 is a sectional view of a fragment of the apparatus of FIG. 1 on an enlarged scale

The seal may be positioned to seal between the inner casing and the drill pipe in any desired manner which will maintain the seal below the kelly 20. "kelly" as used herein is that section of the drill string which cooperates with the rotary table to rotate the drill string. The remainder of the drill string is "drill pipe". FIG. 2 illustrates a form of this invention in which the seal 28 is carried on the drill pipe 16 immediately below the kelly 20. While shown adjacent the kelly it may be placed at any desired location below the kelly for engagement with the inner casing 13. The seal may take any desired form which will seal between the drill pipe and inner casing. In the illustrated form an inverted cup-shaped seal is shown. The seal is generally in the form of an inverted swab cup and those skilled in the art can provide suitable seals for this service. The seal is secured to the drill pipe by any desired means (not shown). When a rotary swivel is used to rotate the drill pipe the seal will be positioned below the blowout preventer stack at all times during drilling.

As the seal blocks the usual drilling fluid return path a return fluid conduit is provided. For instance a port 29 is provided in the inner casing 13 below the seal 28 in all drilling positions to communicate the interior of the inner casing with the annulus 27 between the inner and outer casings. Thus returns of drilling fluid flow through the port 29, to annulus 27, and exit the well through port 14 in the drilling head.

In the FIG. 2 form of the invention the inner casing 13 is suspended by an inner casing hanger 31 supported on a shoulder 32 in the drilling head 12. During completion of the well the drilling head will be replaced by a casing head which will support an imperforate inner casing which will be connected to the inner casing therebelow as disclosed hereinbelow.

The drill pipe section supporting the seal 28 is preferably a short mandrel section 16*a* and additional drill pipe will be added below this short mandrel section. This design results in the seal being exposed to view each time a new section is added to the drill pipe and permits visual inspection of the condition of the seal. The disadvantage of carrying the seal on the drill string is that the seal provides a large area responsive to well pressure which urges the drill pipe in an upward direction. In most cases the hydrostatic head of the liquid in the casing-tubing annulus is sufficient to contain well pressures. The problem arises when a gas bubble rises through the liquid in the annulus and this gas is effective on the seal. Provision may be made to seal the annulus below the seal as disclosed hereinbelow or the seal may be raised above a blowout preventer and the preventer closed about the drill string below the seal before the seal is removed from the well. The seal will engage the bore in the blowout preventers between blowout preventer ram and continue to function until it is raised above the blowout preventer stack.

Figure 3:
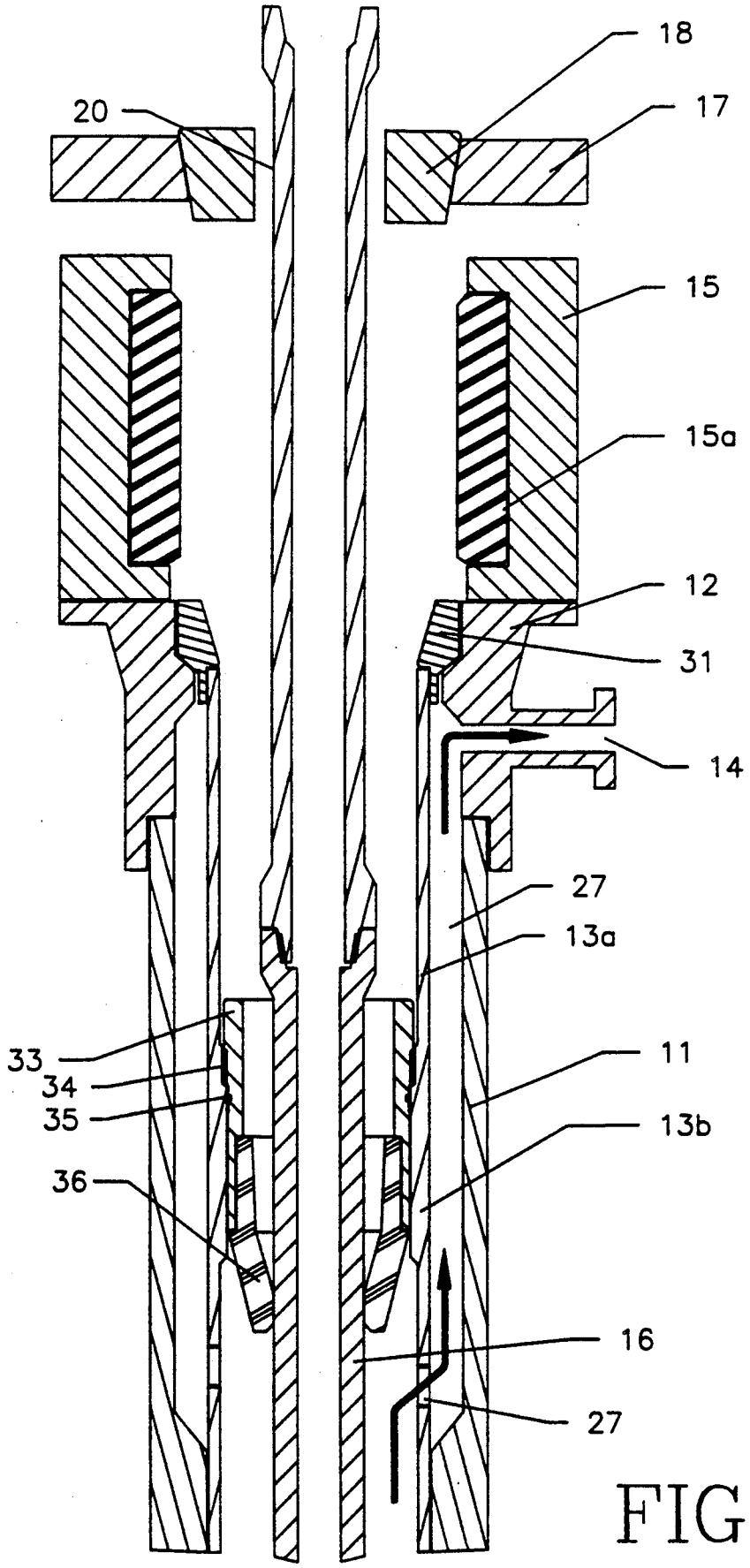
FIG. 3 is a sectional view of a drilling apparatus showing a modified form of this invention.

FIG. 3 illustrates mounting the seal in the casing. The inner casing 13*a* has reduced diameter section 13*b*. The seal is carried on a sleeve 33 and threads 34 on the sleeve and inner casing support the seal in the inner casing. A seal such as O-ring 35 seals between the inner casing and sleeve. The sleeve carries a seal member 36 bonded or otherwise sealing secured to the sleeve. The seal member 36 necks downwardly and inwardly to provide an annular bore therethrough for engaging a drill pipe 16 as shown. The sealing engagement permits longitudinal and rotational movement of the drill pipe while maintaining a seal between the drill pipe and seal member. This design has the advantage of the seal being supported by the inner casing which absorbs any force of well pressure on the seal member. The disadvantage is that the seal is more difficult to replace than the form shown in FIG. 2.

Figure 4:
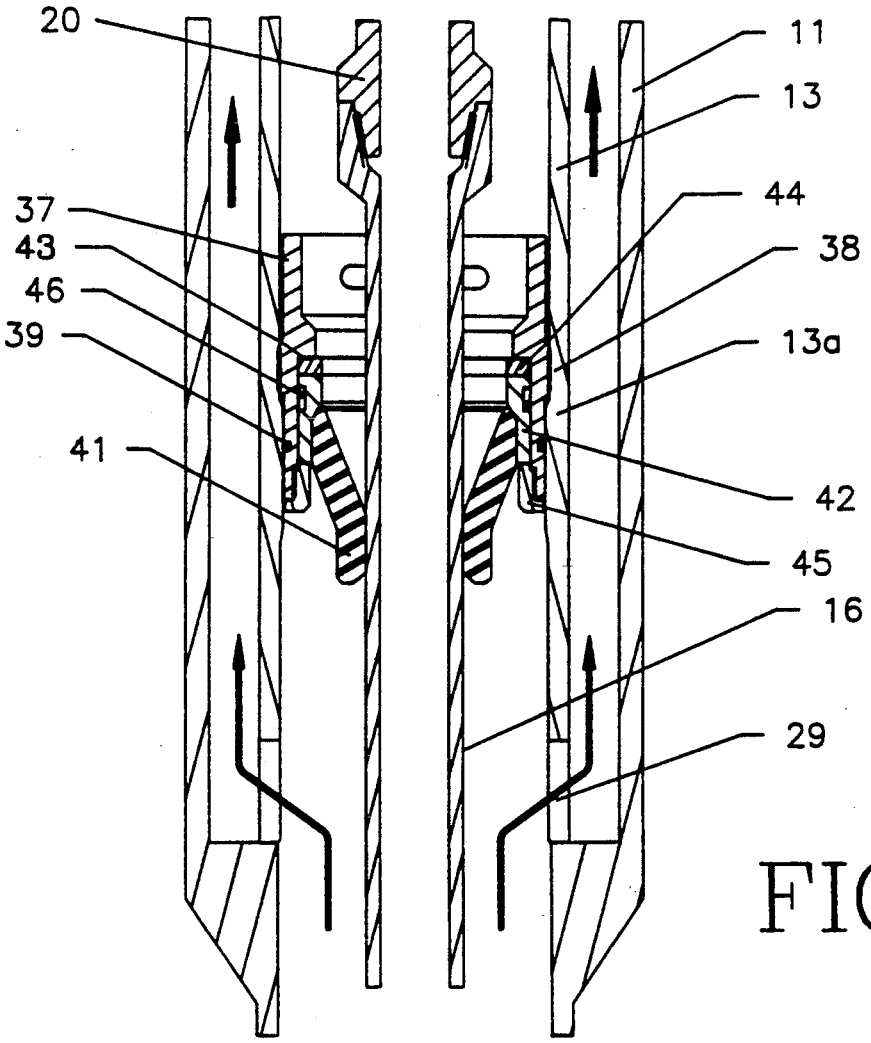
FIG. 4 is a sectional view of a drilling head showing a modified form of this invention.

FIG. 4 illustrates a form of seal which may rotate with the drill pipe. A sleeve 37 is supported in inner casing 13*a* by threads 38 on the inner casing and sleeve. An O-ring 39 seals between the sleeve and inner casing. The seal member 41 is carried by a seal mandrel 42. The sleeve has a downwardly facing shoulder 43 and a thrust bearing 44 is positioned between this shoulder and the seal mandrel. A retainer cap 45 secures the bearing and mandrel in place. A suitable seal such as O-ring 46 seals between the mandrel and sleeve. As the sleeve mandrel 42 is rotatably mounted in the sleeve and supported by the thrust bearing the seal 41 may rotate with the drill pipe.

Figure 7:
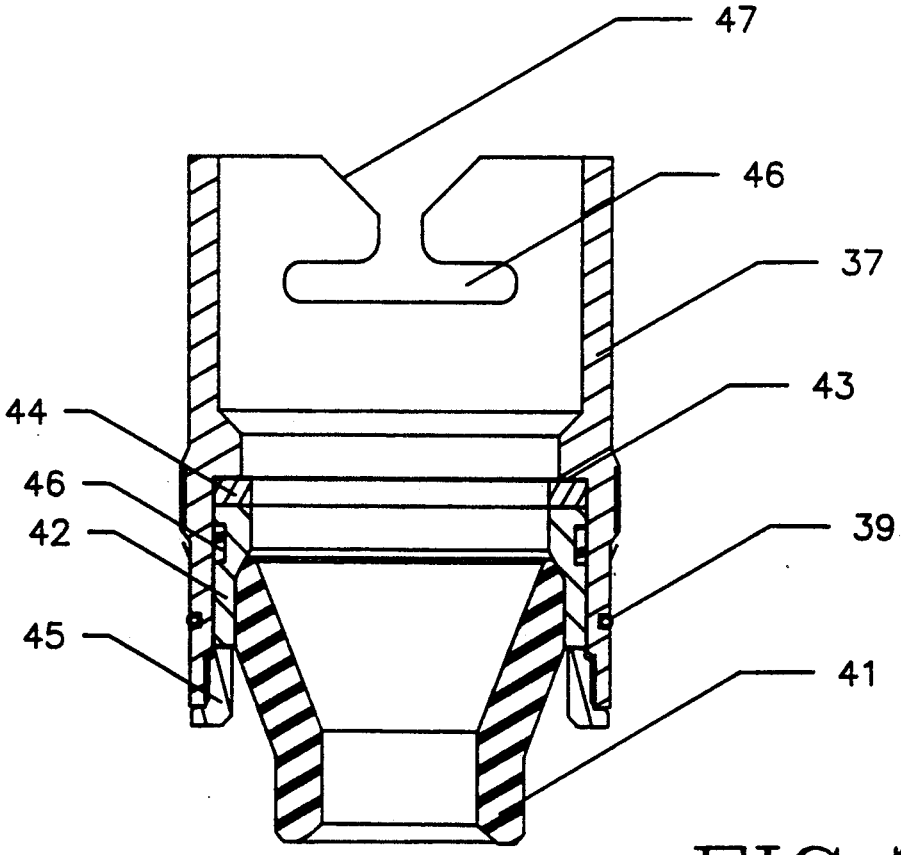
FIG. 7 is a sectional view of a preferred form of seal for use with this invention.

The seal means of FIG. 4 is shown in FIG. 7 to have an inverted T-shaped slot 46 opening into a tapered guide 47 at the top of the slot. This structure receives a running and pulling tool for replacing or redressing a worn seal means.

Figure 6:
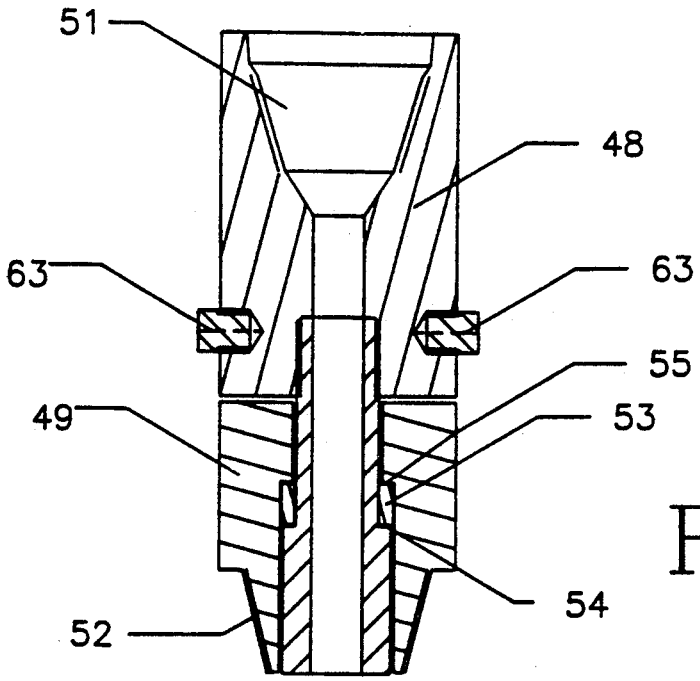
FIG. 6 is a sectional view of a running and retrieving tool for use with this invention.

FIG. 6 shows a running and pulling tool which may be made up in a drill string to pull a worn seal means and replace it with a new or redressed seal means. While the seal means may be replaced when the drill string is out of the hole it is desirable to be able to replace the seal means with the drill string in the hole.

The running and pulling tool includes upper tubular section 48 connected to a lower tubular section 49 by a rotatable connection. Threads 51 are provide in the upper section and threads 52 are provided in the lower section for making up the tool in a drill string. The rotatable connection permits the rotation of the upper section of the tool without rotating the drill string therebelow. The rotatable connection may take any desired form. A mandrel 50 may be extended through the lower section and threadedly connected to the lower end of the upper section. A bearing 53 is positioned between an upwardly facing shoulder 54 in the mandrel and a downwardly facing shoulder 55 on the lower section to suspend the lower section from the upper section.

In order to engage the tool with the seal means lugs 63 are provided on the upper section which will pass through the tapered guide 47 on the sleeve 37 and enter into the slot 46. Rotation of the drill string will rotate the upper section 48 of the tool to rotate the sleeve relative to the inner casing to make up or release the seal means.

During pulling and running a casing supported seal, the well may be open up to the blowout preventers. As the seal is passed through the blowout preventers control of the well may be difficult. In accordance with this invention an additional surface controlled subsurface seal is provided between the inner casing and drill string below the seal means for selectively sealing the annulus and controlling the well while the seal is being pulled or run.

Figure 8:
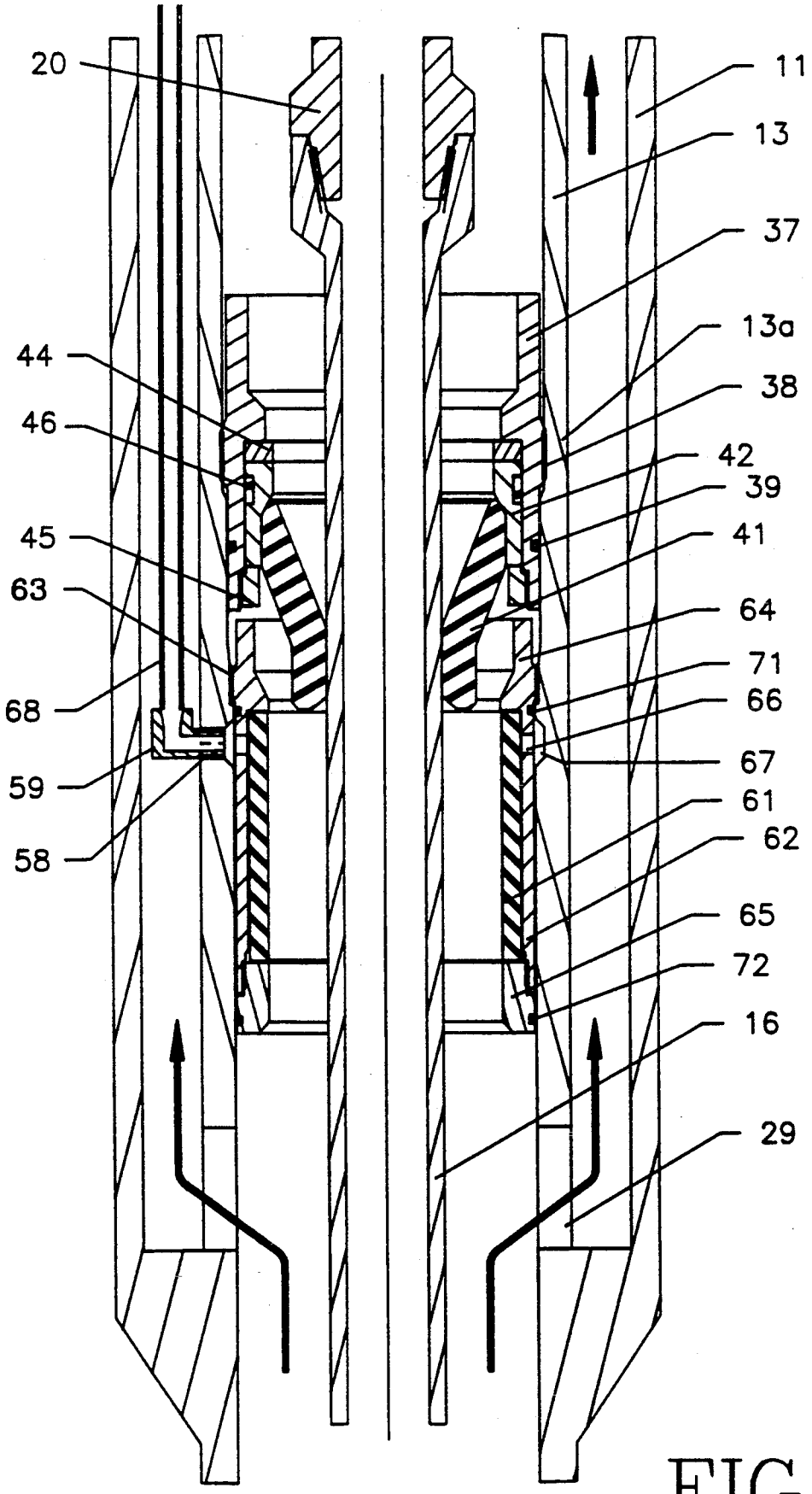
FIG. 8 is a sectional view of apparatus in accordance with this invention which includes a packer for sealing about the drilling string.

FIG. 8 illustrates a surface controlled subsurface seal. An inwardly expansible elastomer seal 61 is carried on mandrel 62. The mandrel is secured in inner casing by threads 63. The seal is secured to the mandrel by top cap 64 and bottom cap 65. The mandrel has a plurality of ports 66 therethrough for admitting fluid behind the elastomer to expand it into sealing engagement with the drill string. This port is in register with a fluid distribution groove 67 which receives fluid from the surface through line 68. Fluid is confined by O-rings 71 and 72 in the top and bottom caps respectively. When it is desired to change the seal means to redress any part thereof such as O-ring 46 or seal 41 the line 68 may be pressurized to extend elastomer seal 61 into engagement with the drill string. This will provide control of the annulus while the seal means is being passed through the blowout preventers.

A further feature of this invention is the provision of a subsurface safety valve controlling returning drilling fluid which may be activated when desired. For instance damage to equipment on the surface may make it desirable to shut in the well below the drilling head to returning drilling fluid.

Figure 9:
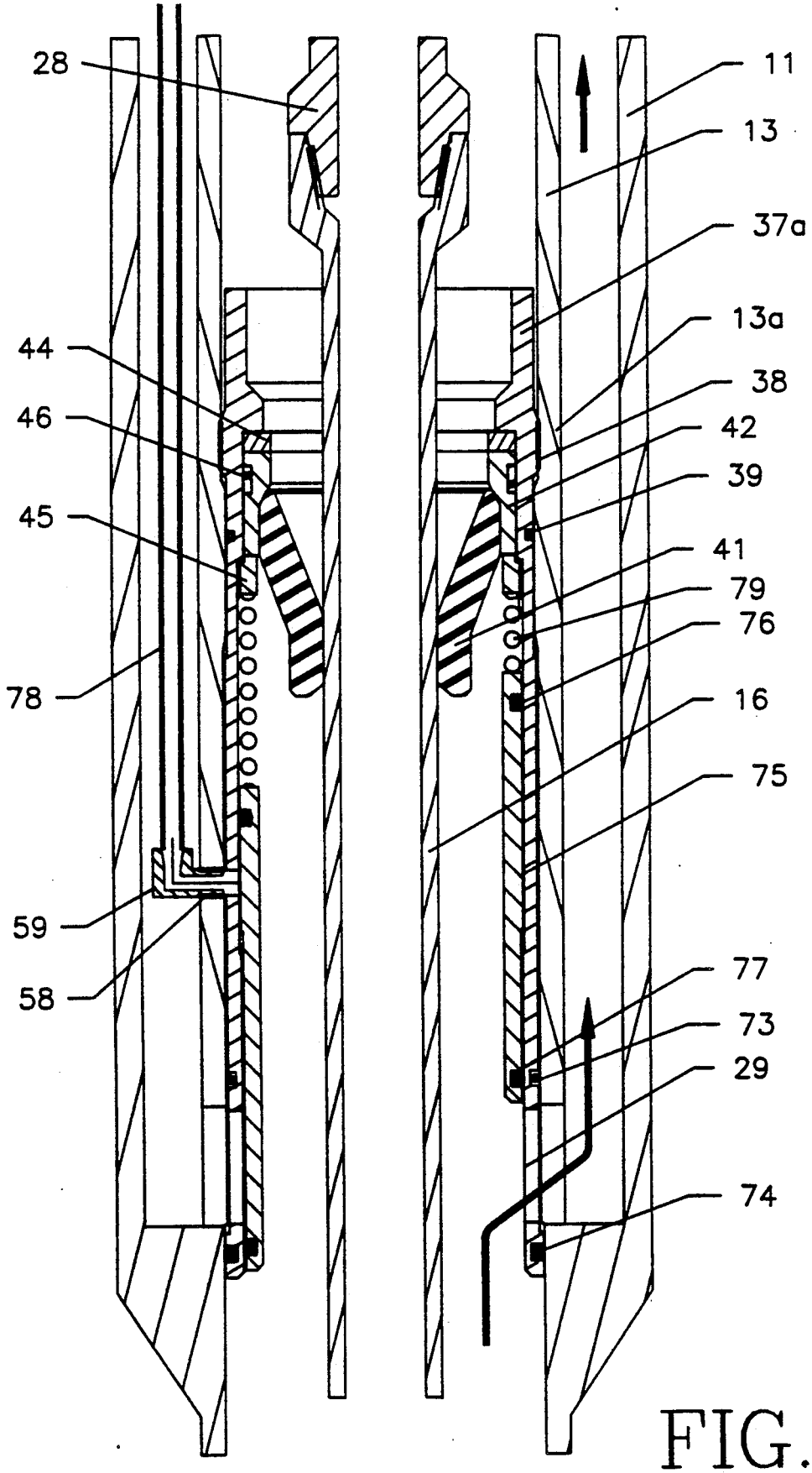
FIG. 9 is a sectional view of apparatus in accordance with this invention which includes a subsurface control valve.

FIG. 9 illustrates a subsurface safety valve associated with the seal means. The seal mandrel sleeve 37*a* extends downwardly to overlie the flow port 29. O-rings 73 and 74 in the sleeve straddle the port 29 to seal with the inner casing. A sliding sleeve valve member 75 carries spaced O-rings 76 and 77 for sealing with the sleeve 37*a*. The sliding sleeve has a larger diameter at O-ring 76 than at O-ring 77 to provide a pressure responsive area for urging the sleeve valve member 75 upwardly when the pressure in the area between the O-rings 76 and 77 is increased through line 78 from the surface. A spring 79 urges the valve member 75 to valve closing position and when pressure in the line 78 is reduced the spring will move the valve member downwardly to close port 29. The pressure in line 78 may be controlled in any desired manner to automatically or manually control the valve.

Figure 10:
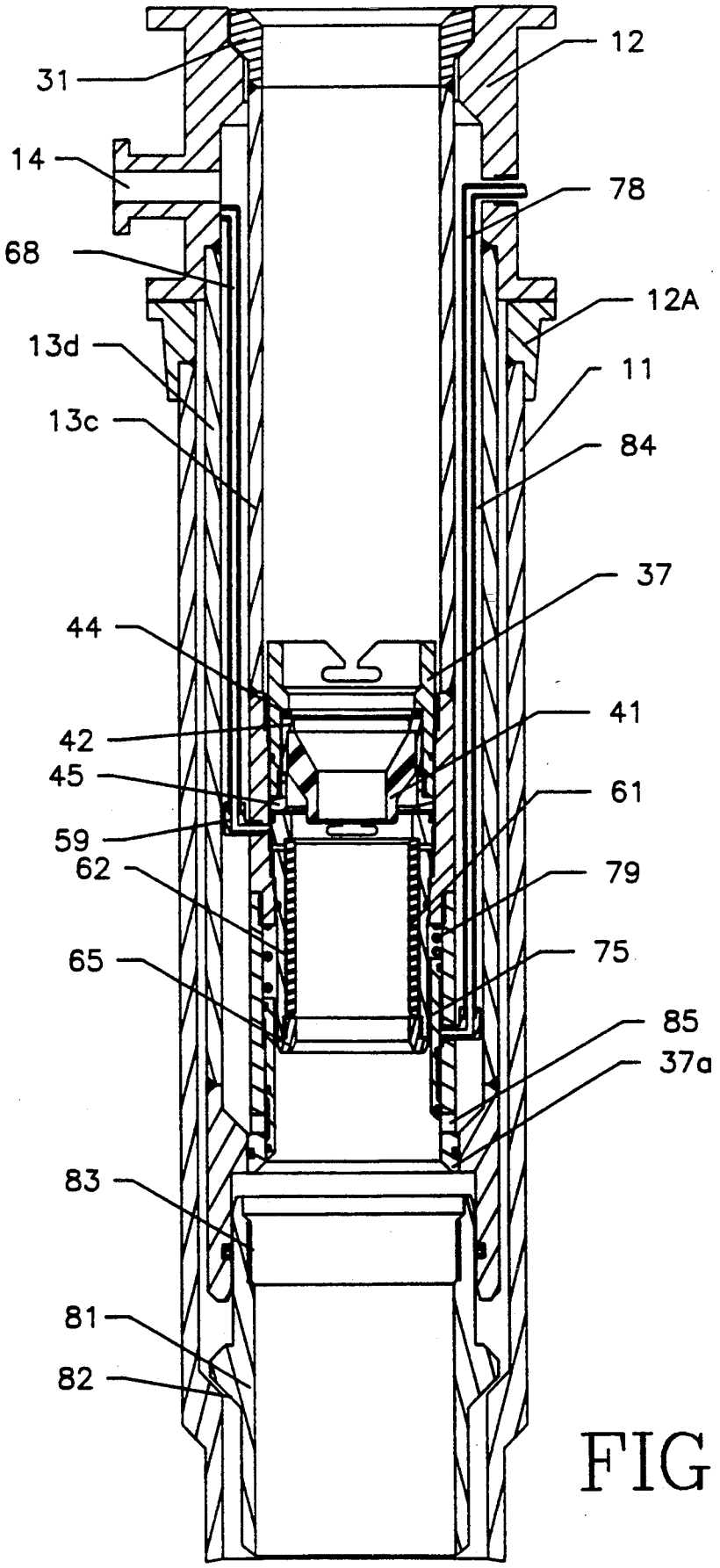
FIG. 10 is a sectional view showing the preferred form of drilling head of this invention positioned in a well.
Figure 11:
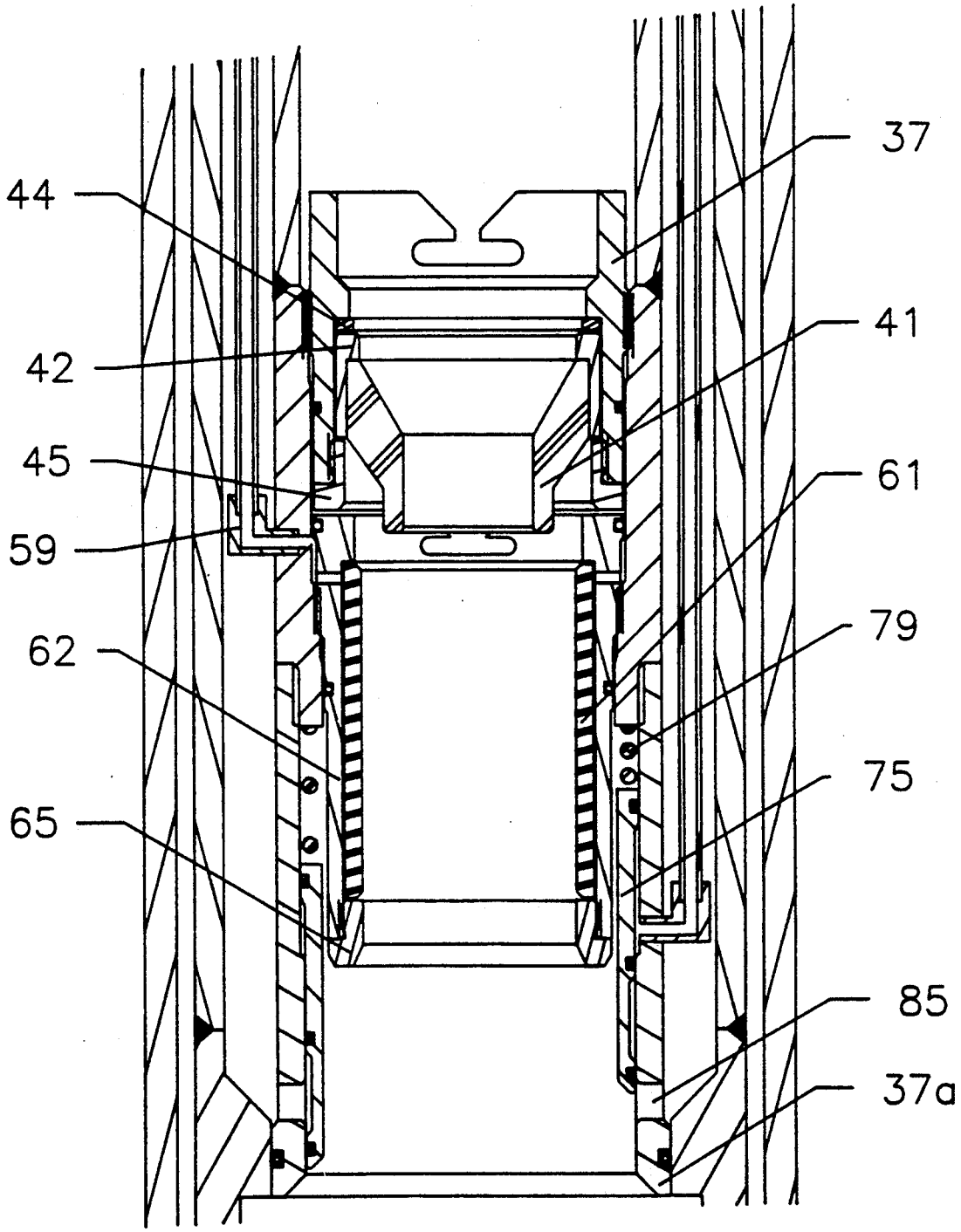
FIG. 11 is a fragment of FIG. 10 on an enlarged scale.

FIG. 10 shows the preferred form of this invention. After the outer casing 11 has been run and cemented in place the well is drilled to the depth at which the inner casing is to be set. This depth will be above any producing formation. Then the casing 81 is run and hung from a shoulder 82 in the outer casing. This casing 81 will have threads 83 for receiving a casing when the well is finally completed.

The drilling head 12*a* is mounted on the outer casing. The inner casing is provided by concentric casing 13*c* and 13*d*. The annulus between these casings conducts returns from port 85 to the wellhead outlet 14. The seal means is the same as shown in FIGS. 7 and 8. The subsurface safety valve is the same as shown in FIG. 8.

Depending from the subsurface safety valve is an overshot 85 which sealingly engages the outer diameter of casing 81 when the drilling head is secured in place. When the well is completed the drilling head and the depending casings 13*c* and 13*d* are removed. A final casing can then be run and secured to threads 83 in casing 81.

From the above it will be seen that the objects of this invention have been accomplished. A control seal has been provided down hole at a location remote from the kelly and below the blowout preventers controlling flow in the casing-drill string annulus. Fluid returns are directed from below the seal to an outlet port on the drilling head.

By inflating the elastomer seal below the control seal the well is closed in below the elastomer seal and the control seal may be lubricated through the blowout preventer for replacement or repair while maintaining the well under complete control.

The subsurface safety valve can be arranged to automatically close in the event of a failure at the surface to close in returns from the well. With this feature closing of the blowout preventers and plugging of the drill string permits complete shut in of the well when desired.

The foregoing disclosure and description of the invention is illustrative and explanatory thereof and various changes in the size, shape and materials, as well as in the details of the illustrated construction may be made within the scope of the appended claims without departing from the spirit of the invention.

What is claimed is:

1. A drilling assembly comprising;
an outer casing positioned in a well,
a drilling head having a fluid flow outlet mounted on said outer casing,
a drilling head casing depending from said drilling head and positioned within said outer casing,
said drilling head casing having a diverter flow port in fluid communication with said fluid flow outlet,
blowout preventer means mounted on said drilling head,
rotating means above said blowout preventer means for rotating a drill pipe,
a drill pipe suspended from said rotating means, and
seal means carried by one of said drilling head casing and drill pipe and sealing therebetween,
said seal means positioned above said diverter flow port and below said blowout preventer means

2. A drilling assembly comprising;
an outer casing positioned in a well,
a drilling head having a fluid flow outlet mounted on said outer casing,
a drilling head casing depending from said drilling head and positioned within said outer casing,
said drilling head casing having a diverter flow port in fluid communication with said fluid flow outlet,
blowout preventer means mounted on said drilling head,
a rotary table mounted on said blowout preventer means,
a kelly bushing in said rotary table,
a kelly suspended in said kelly bushing,
a drill pipe suspended from said kelly, and
seal means carried by one of said drilling head casing and drill pipe and sealing therebetween,
said seal means positioned above said diverter flow port and below said kelly in all drilling positions of said kelly.

3. The assembly of claim 2 wherein said seal means is carried by said drill pipe.

4. The assembly of claim 2 wherein said sea means is removably mounted in said drilling head casing.

5. The assembly of claim 2 in combination with a surface controlled expansible packer mounted in said drilling head casing below said seal means for sealing between the drilling head casing and a drill pipe.

6. The assembly of claim 2 in combination with a surface controlled valve mounted in said drilling head casing and controlling flow through said diverter flow port.

7. The assembly of claim 2 wherein said seal means is mounted in said drilling head casing for rotation relative to said drilling head casing while sealing therewith.

8. The assembly of claim 2 wherein said seal means comprises;

a tubular sleeve releasably secured in sealing relationship with said drilling head casing, a seal mandrel sealingly and rotatably mounted in said sleeve, and a tubular seal member carried by said mandrel for sealingly engaging a drill pipe.

9. The assembly of claim 8 wherein said tubular sleeve has a T-slot engageable means therein;

and said assembly is in combination with a tool for running and retrieving said sleeve comprising:

upper and lower tubular sections with lugs in the upper section engageable in said T-slot, means on the lower end of the tool for supporting a drill string, and means between said upper and lower sections providing for rotation therebetween.

10. The assembly of claim 8 in combination with an inwardly expansible elastomer seal for sealing between the tubing head casing and a drill pipe below the seal means.

11. A drilling method comprising:

mounting a drilling head on a cased well, mounting blowout preventer means on said drilling head, rotating a drill pipe in said drilling head, sealing between the drilling head and drill pipe below the blowout preventer means, and directing drilling fluid returns from the well below the seal to the exterior of the drilling head.

12. A drilling method comprising:

mounting a drilling head with a rotary table thereon on a cased well, rotating a drill pipe by rotating a flat sided kelly in said rotary table, sealing between the drilling head and drill pipe below the kelly in all drilling positions of the kelly, and directing drilling fluid returns from the well below the seal to the exterior of the drilling head.

13. A drilling method comprising:

suspending an outer casing in a well, suspending an inner casing in said outer casing, supporting a drilling head on said outer casing with a drilling head casing in the head in sealing relationship with said inner casing, mounting a seal means including a tubular seal in said drilling head casing, mounting a rotary table on said drilling head, positioning a drill pipe in said well with said pipe in sealing engagement with said tubular seal and with a kelly extending through said rotary table, rotating the drill pipe to drill the well while maintaining the kelly above the seal means, and directing returning drilling fluid through a diverter flow port in said drilling head casing below said seal mean to an outlet port on said drilling head.

14. A drilling method comprising:

mounting a drilling head on a cased well;

said drilling head having a rotary table thereon, a seal means for sealing between the drilling head and a drill pipe, and a surface controlled seal below the seal means for sealing between the drilling head and a drill pipe;

inserting a drill pipe through said seal means and surface controlled seal;

rotating the drill pipe by rotating a kelly in said rotary table while maintaining said seal means in sealing engagement with the drill pipe in all drilling positions of the kelly;

directing drilling fluid returns from the well below the seal means to the exterior of the drilling head;

activating a surface controlled seal in the well below the seal means to seal between the drilling head and drill pipe to seal in the well;

inserting a retrieving tool in the drill pipe;

lowering the drill pipe to attach the retrieving tool to the seal means and retrieving the seal means;

attaching a new seal means to the retrieving tool and landing the new seal means in the well head; and withdrawing the retrieving tool from the well and opening the surface controlled seal.

* * * * *